US005159241A

United States Patent [19]

Kato et al.

[11] Patent Number: 5,159,241

[45] Date of Patent: Oct. 27, 1992

[54] SINGLE BODY RELATIVISTIC MAGNETRON

[75] Inventors: Keith G. Kato, Rancho Cucamonga; James C. Weatherall, Upland, both of Calif.

[73] Assignee: General Dynamics Corporation Air Defense Systems Division, Pomona, Calif.

[21] Appl. No.: 602,549

[22] Filed: Oct. 25, 1990

[51] Int. Cl.[5] ..... H01J 23/05; H01J 25/50

[52] U.S. Cl. ..... 315/39.51; 315/39.53; 331/86; 313/346 R; 313/446

[58] Field of Search ..... 315/39.51, 39.53, 39.63, 315/39.67, 39.75, 4, 5; 331/86; 313/336, 346 R, 310, 311, 446

[56] References Cited

U.S. PATENT DOCUMENTS

| | | | |
|---|---|---|---|
| 2,513,933 | 7/1950 | Gurewitsch | 315/39.63 X |
| 2,869,012 | 1/1959 | Müller | 315/39.75 X |
| 3,109,123 | 10/1963 | Spencer | 313/336 X |
| 3,305,753 | 2/1967 | White | 315/39.75 X |
| 3,312,859 | 4/1967 | Wilbur et al. | 315/39.75 X |
| 4,053,850 | 11/1977 | Farney et al. | 331/91 |
| 4,100,458 | 7/1978 | Pickering et al. | 315/39 |
| 4,145,635 | 3/1979 | Tuck | 315/5.39 |
| 4,200,821 | 4/1980 | Bekefi et al. | 315/39.51 |
| 4,310,786 | 1/1982 | Kumpfer et al. | 315/39.51 |
| 4,348,649 | 9/1982 | Lohrmann | 331/96 |
| 4,465,953 | 8/1984 | Bekefi | 315/39.71 |
| 4,480,210 | 10/1984 | Preist et al. | 315/4 |
| 4,518,932 | 5/1985 | Pickering | 331/90 |
| 4,527,091 | 7/1985 | Preist | 315/5 |
| 4,533,875 | 8/1985 | Lau et al. | 330/4 |
| 4,588,965 | 5/1986 | Cook | 331/91 |
| 4,629,938 | 12/1986 | Whitham | 315/5.41 |
| 4,677,342 | 6/1987 | MacMaster et al. | 315/39.3 |
| 4,705,989 | 11/1987 | Takada et al. | 315/39.51 |
| 4,721,885 | 1/1988 | Brodie | 313/576 |
| 4,757,269 | 7/1988 | Friedman et al. | 330/47 |
| 4,763,043 | 8/1988 | MacMaster et al. | 315/5.12 |

*Primary Examiner*—Eugene R. LaRoche
*Assistant Examiner*—Benny T. Lee
*Attorney, Agent, or Firm*—Leo R. Carroll

[57] ABSTRACT

A relativistic magnetron device comprising an elongate cathode shank extending along the axis of the device and a cylindrical anode surrounding the cathode shank along at least part of its length to define an annular interaction area. The anode has an even number of resonator cavities facing the cathode, and microwave extraction devices are connected to alternate resonator cavities to extract power from the device. The cathode has a central, emission band extending from the center of the interaction area in opposite directions and terminating short of the ends of the anode, while the remainder of the cathode is non-emitting.

15 Claims, 3 Drawing Sheets

SINGLE BODY RELATIVISTIC MAGNETRON

CROSS-REFERENCES TO RELATED APPLICATIONS

This application is related to a co-pending application Ser. No. 07/632,024 for "Cascaded Relativistic Magnetron" by the same applicants, filed Dec. 21, 1990.

BACKGROUND OF THE INVENTION

I. Field of the Invention

This invention relates generally to magnetron design, and is particularly concerned with an improved design for a cold or field emission cathode relativistic magnetron.

II. Description of Related Art

The conventional magnetron is a well-known and very efficient source of low frequency microwaves. Its operating principles have been known since at least 1921, and the first pulsed resonant cavity magnetron (3 GHz), built by the British in 1940, can be considered the germinal point of modern microwave radar. Today, magnetrons can be found in every home possessing a microwave oven.

A typical magnetron is a coaxial vacuum device consisting of an external cylindrical anode (the positive electrode, which attracts electrons) and an internal, coaxial cylindrical cathode (the negative electrode, which emits electrons). In many designs, resonator cavities of various shapes, such as rectangular, are cut into the anode block in a gear tooth pattern. During operation, a constant axial magnetic field fills the vacuum annulus, and an electric potential is placed between the anode and cathode. The number and shape of the resonator cavities, and the dimensions of the anode and cathode are arbitrary design features which determine the magnetron's frequency and operating characteristics.

Because of boundary conditions on electromagnetic fields at conducting surfaces, only certain field patterns sinusoidally oscillating in time at discrete frequencies (the "normal modes") will exist inside the magnetron cavity. These normal modes constitute a mathematically complete and orthogonal set, meaning any arbitrary electromagnetic field within the cavity can be decomposed into a sum of normal modes of the appropriate amplitudes and phases. The magnetron operation begins when an electric potential is applied between the two electrodes, initiating electron flow from cathode to anode. The axial magnetic field acts to insulate the electrodes by confining the electrons to the annular region inside the magnetron. The circular motion of electrons in the crossed electric and magnetic fields stimulates electromagnetic oscillations in the cavity, particularly when the velocity of the electrons matches the phase velocity of one of the normal mode components. As the wave gains energy, the fields back-react on the charge cloud to produce spatial bunching of the electrons, which in turn reinforces the growth of the wave. This bunching narrows the spectrum of preferentially activated modes. The preferred modes then gain energy at even faster rates and thus force even further bunching. The ideal magnetron design would quickly establish one dominant mode and one bunching pattern which stably and self-consistently reinforce each other. The conversion of beam energy to electromagnetic energy can be very efficient in magnetrons—as high as 70% in conventional devices.

Modern commercial magnetrons are typically of the hot (i.e., thermionic) cathode type and typically operate at voltages ranging from a few hundred volts to a few tens of kilovolts. Generally, electrons are produced in these devices by thermionic emission (i.e., heating) from the cathode. Currents of a few hundred amperes can be drawn in this way, and typical output power levels are tens to hundreds of kilowatts. The highest power achieved with this type of conventional magnetron was 7 MW.

In the past decade, the development of high voltage, kiloampere-level pulsed power drivers has led to a new class of experimental "relativistic magnetrons" which produce several orders of magnitude greater power. A magnetron of this type is described in U.S. Pat. No. 4,200,821 of Bekefi, et al. This experimental device used a field-emission cathode, in which the high electrostatic stresses draw large currents, and an anode resonator block having six identical resonator cavities, one of which is tapped for microwave extraction. Using 360 kV, 15 kA, and 0.8 T on a 3 GHz six-vane design, they reported 500–1000 MW in power over a 30 ns pulse. The magnetron has been tested at higher voltages to generate 3 GW of peak power. Further experiments have demonstrated a pulse length of 150 ns, but at a reduced power level of 100 MW. These achievements represent the present state of the art in high power relativistic magnetrons.

Other relativistic magnetrons based on different strategies have generally been less successful. Inverted magnetron designs have been tried, with the anode placed inside the field-emission cathode. This design reduced the current density required of the cathode, and also eliminated the undesirable azimuthal magnetic field resulting from the current injection. A 54-vane design reduced the resonant velocity of electrons. With an anode voltage of 580 kV, this design achieved 0.8 GW for 30 ns.

Deficiencies in the present high power microwave magnetron technology are evident, with the most serious being the inability to generate pulse lengths of a microsecond or greater. This is particularly critical for increasing the energy per pulse being produced. A magnetron producing 500 MW for 3 μs would represent an order-of-magnitude increase in energy per pulse over the present experimental devices, and is greatly desired for practical applications.

The intrinsic limit to long pulses seems to be gap closure. Gap closure occurs when the formation of a plasma from electron bombardment of the anode interferes with the electromagnetic operation of the magnetron, either by providing a shorted current path, or by detuning the cavity. The pulse lasts for about the time it takes ions to cross the interaction region; this travel velocity is typically about 1 cm/μs. In magnetrons with field-emission cathodes as described in U.S. Pat. No. 4,200,821, small, millimeter-size anode-cathode gaps are required to induce field-emission. This is counterproductive to long pulse lengths, since the transit time across a small gap is necessarily small. The problem is especially serious in relativistic magnetrons because megavolt potentials produce rapid acceleration of ions. Substantial anode damage is evidence of abundant ion generation. Nonetheless, for high power microwave generation field-emission cathodes are preferred over thermionic ones because of their ability to supply large currents. A long pulse, high power device would mark a major advancement of magnetron technology.

There are also practical problems with relativistic magnetrons. Anode erosion is severe because the large electron kinetic energy and the large currents produced in relativistic field-emission magnetrons rapidly degrade the surface quality of the anode, limiting the life of the device to a few hundred shots. The high voltages contribute to the gap closure problem. Although high power is achieved, conversion efficiencies seem to drop as relativistic energies are approached. Relativistic energies also require physically larger energy storage and magnetic field systems. Thus, there are a number of reasons why obtaining high power with nonrelativistic or moderately relativistic voltages would be a significant technological achievement.

SUMMARY OF THE INVENTION

It is an object of this invention to provide an improved single body relativistic magnetron device having increased microwave pulse duration.

According to the present invention, a relativistic magnetron device is provided, which comprises an elongate field emission cathode shank extending along the axis of the device and an anode surrounding the cathode along at least part of its length to define a central annular interaction volume between the anode and cathode, the anode having N identical resonator cavities facing the cathode, where N is an integer power of 2, and the cathode having a central field emission band extending from the center of the device in both directions and terminating short of the outer ends of the anode, the remainder of the cathode having a non-emitting surface. Suitable microwave extraction devices such as waveguides or the like are provided for extracting microwave energy from alternate ones of the resonator cavities.

In a preferred embodiment of the invention, the cathode has an emitting surface of fuzzy or fibrous texture, which can ignite at lower electric field stresses than smooth texture cathode materials. The non-emitting areas are of a suitable non-emitting material, such as anodized aluminum. Preferably, the emitting material is a graphite felt material, such as that produced by Quantum Diagnostics, Ltd.

Preferably, the cathode shank projects out from opposite ends of the anode and is surrounded at each end by an annular waveguide structure defining a co-axial waveguide end space at opposite ends of the device which acts as a boundary. The diameter of the waveguide structure is equal to the inner diameter of the anode, and annular anode end caps are provided at the inner end of each of the waveguide structures to physically cap the axial ends of the resonator cavities while permitting the annular interaction space to remain open. This arrangement establishes a firm, lowest order axial standing wave pattern with the coaxial mode in electromagnetic cutoff at the $\pi$-mode frequency.

BRIEF DESCRIPTION OF THE DRAWINGS

The invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
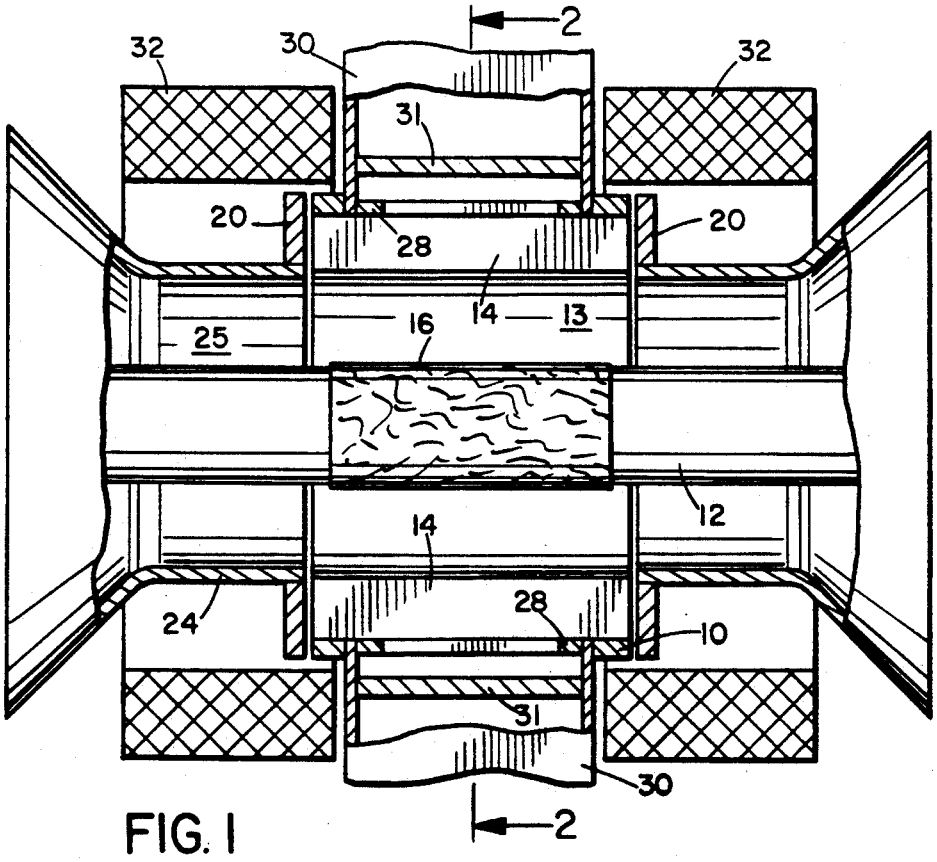
FIG. 1 is a side elevation view, with portions cut away, of the basic magnetron structure, according to a preferred embodiment of the invention.
Figure 2:
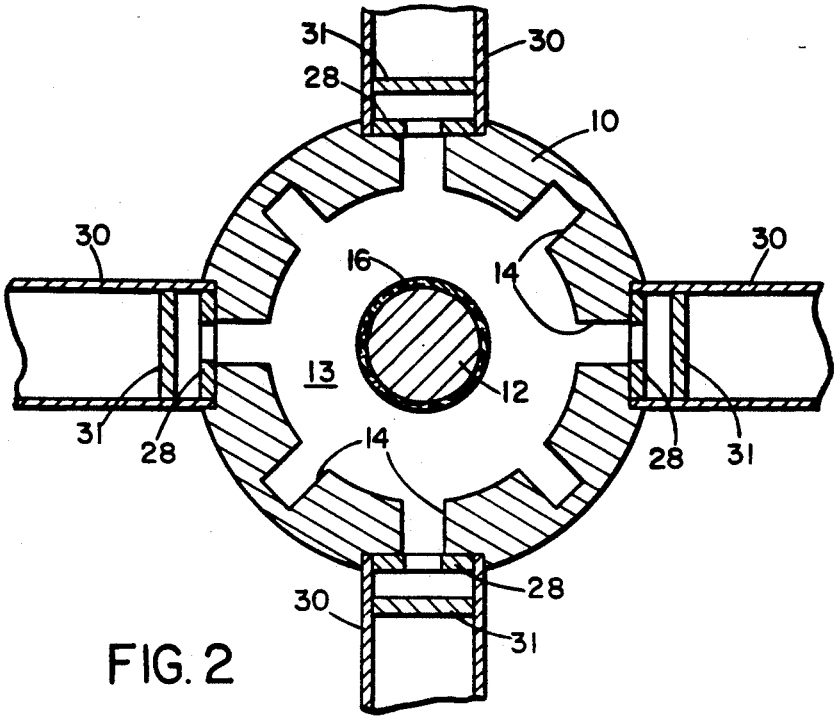
FIG. 2 is a sectional view taken on line 2—2 of FIG. 1.

FIGS. 1 and 2 of the drawings illustrate a relativistic magnetron device according to a preferred embodiment of the present invention. The device basically comprises a coaxial vacuum enclosed device comprising an external, cylindrical anode 10 and an internal, coaxial cylindrical cathode 12 defining an annular interaction space 13 between the inner surface of the anode and the outer surface of the cathode. A series of identical uniformly spaced rectangular resonator cavities 14 are cut into the inner surface of the anode. Although the resonator cavities are of rectangular shape in the illustrated embodiment, this is not essential and other, alternative shapes may be used, for example as in Bekefi's A-6 magnetron described in U.S. Pat. No. 4,200,821 of Bekefi referred to above. The number and shape of the resonator cavities and the dimensions of the anode and cathode will determine the magnetron's frequency and operating characteristics. In the preferred embodiment of the invention, the number of resonator cavities is an integer power of 2 and the magnetron is designed to operate in the $\pi$-mode, since this mode has the greatest stability.

As best illustrated in FIG. 1, the cathode is longer than the anode and projects outwardly from opposite ends of the anode. The cathode surface is made non-emitting, e.g. by anodizing, apart from a central electron emitting region or band 16 which terminates short of the ends of the anode. Preferably, the emitting region comprises a layer covering the cathode shank. The layer is of a special material having a fuzzy or fibrous surface texture which encourages local field enhancement, so the material can ignite at much lower electric field stresses, and thus at much larger anode-cathode spacing, than standard field emission relativistic magnetron cathode materials, and which has a much higher current density than thermionic cathode magnetrons. In the preferred embodiment of the invention, the material 16 comprises a graphite felt cathode material as manufactured by Quantum Diagnostics, Ltd. of Hauppauge, New York. A layer 16 of this material is bonded to the cathode surface in the desired area and vacuum baked to permit its operation in the $10^{-8}$ torr vacuums needed in magnetrons. This allows the anode-cathode spacing to be much larger than in other relativistic magnetrons while still permitting ignition, increasing the output pulse length, as will be explained in more detail below. Alternatively, "vacuum tube" field emission cathodes may be fabricated onto the surface of the central region 16 of the cathode to produce equivalent results. Field emission cathodes of this type are described in U.S. Pat. No. 4,721,885 of Brodie.

Figure 7:
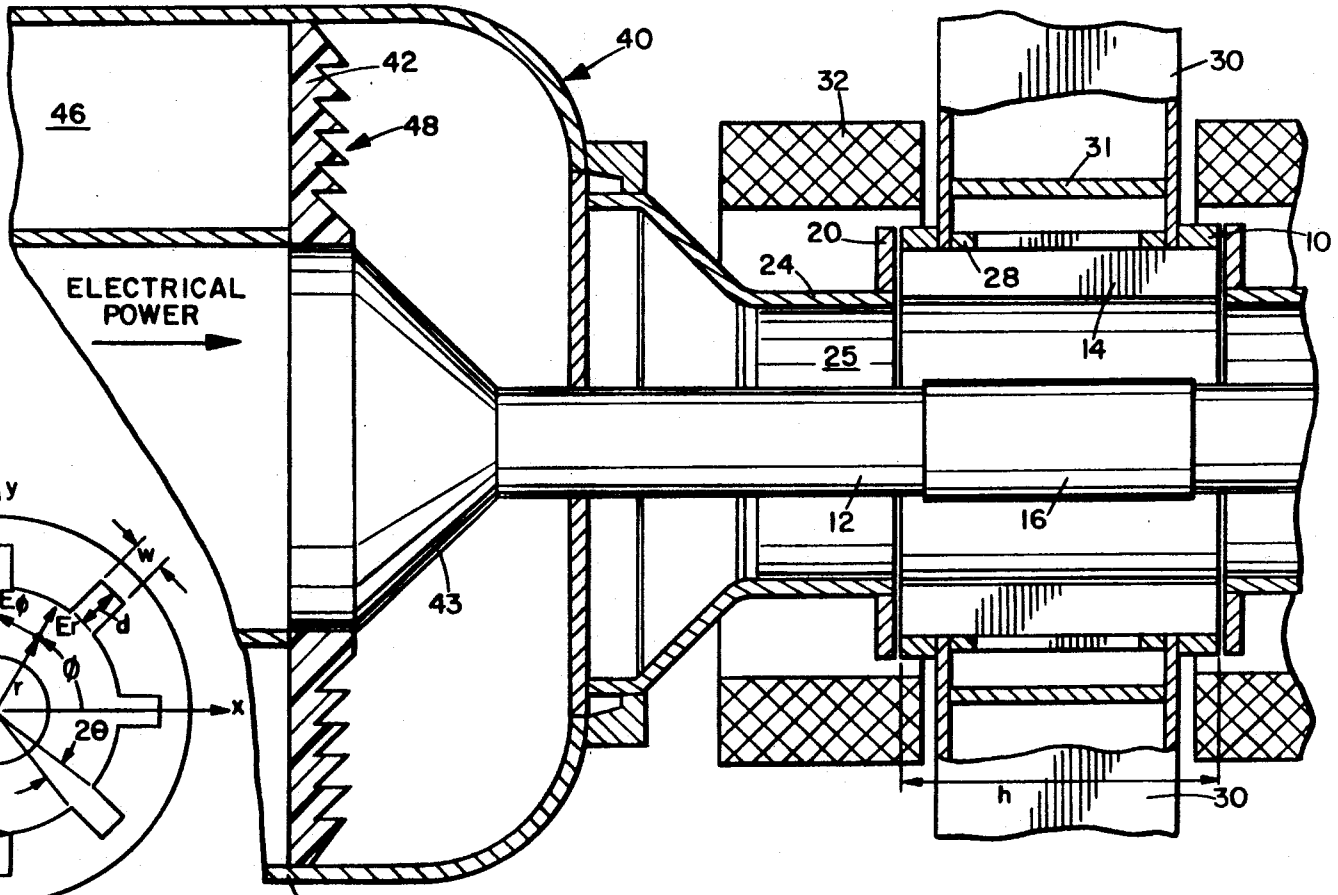
FIG. 7 is similar to a portion of FIG. 1, showing an end support housing and connection structure.

As best illustrated in FIG. 1 resonator cavities of the anode are capped at each end by suitable conductive boundaries comprising annular end plates 20 of conductive material having an outer diameter and inner diameter equal to the outer and inner diameters, respectively, of the anode. Extending outwardly from end plates 20 are tubular sleeves or waveguide extensions 24 having an internal diameter equal to the internal diameter of the anode to define annular waveguide end spaces 25 at opposite ends of the device. This produces a simple, co-axial waveguide structure which is designed to be in cut-off for the $\pi$-mode. The annular end spaces are designed as simple coaxial waveguide structures, but they also act as boundaries. By examination, the $\pi$-mode field pattern in the magnetron annulus is virtually identical to the $TE_{41}$ field pattern in the end space waveguide. This coaxial waveguide mode is in electromagnetic cut-off at the $\pi$-mode frequency. Output power from the magnetron can therefore be increased or maximized by the axial boundaries. Suitable end supports or caps for supporting the cathode shank coaxially within the anode are provided as shown in FIG. 7, and the structure is enclosed in a vacuum envelope in a suitable manner, as is well known in the magnetron field.

Alternate cavities of the anode are each coupled to an external load via a quarter wave transformer coupling iris 28 connecting the respective cavity to an output waveguide 30, which is suitably sealed off, for example by a vacuum-tight dielectric window 31. The waveguides used will depend on the design operating frequency of the magnetron. For the described example, standard WR-284 or S-band waveguides may be used, and simple, quarter-wave slot transformers may be used to match the impedance between the magnetron output vanes and the waveguide (see *Microwave Magnetrons*, MIT Radiation Laboratory Series Vol. 6, ed. G.B. Collins, McGraw Hill 1948). The extraction symmetry of this arrangement creates a de facto "rising-sun" magnetron, which is advantageous for operating stability and frequency purity, and also mitigates waveguide breakdown by distributing microwave energy over several waveguides.

Permanent magnets or electromagnets 32 are supported outside the anode as illustrated in Figure in order to generate the desired constant axial magnetic field in the annular interaction cavity. The magnetic field need only be constant in the annular volume surrounding the electron emitting area or band of the cathode. Thus, a "mirror machine" type of magnetic field (similar in configuration to the magnetic "bottles" used to contain plasmas in thermonuclear fusion experiments) may be used. This will have a low magnetic field in the equatorial region but high fields in the end space regions in order to help in constraining the electron flow to the magnetron equator. Such a structure is described, for example, in *Classical Electrodynamics*, by John David Jackson, 2nd Edition, Wiley & Sons Inc., page 592.

Figure 4:
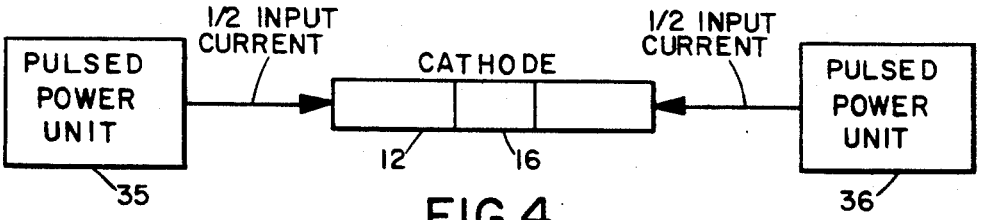
FIG. 4 is a schematic illustrating a symmetrical current feed to the cathode shank.

The desired electric potential is applied between the anode and cathode in order to generate a radial electric field in the cavity to initiate electron flow from the cathode to the anode. A suitable power input is provided to the cathode while the anode is connected to ground. The current feed to the cathode may be applied asymmetrically or unidirectionally as is standard in magnetron design, but in the preferred embodiment of the invention a symmetrical current input is used, as generally illustrated in FIG. 4, with a pulse forming modulator or pulsed power inputs 35, 36 connected via standard electrical transmission lines to the opposite ends of the cathode, so that half of the total input current is fed to each end of the cathode. Alternatively a single pulsed power unit may be connected via dual transmission lines to opposite ends of the cathode. In each case, the impedance of the driver or drivers and connecting lines must be matched to the total impedance of the magnetron. Thus, if the magnetron has a calculated impedance of Z ohms, the two pulse forming elements driving each end of the magnetron should each have an impedance of 2 Zohms. Where two separate pulsed power units are used, they will be driven in synchronism. This improves magnetron efficiency since it eliminates, to the first order, the azimuthal self-induced magnetic field which invariably accompanies asymmetric or unidirectional feeds. Such azimuthal magnetic fields tend to eject electrons out of the magnetron end space at one end of the magnetron, reducing efficiency. This electron loss may also be alleviated in the case of a uni-directional current feed by maximizing the cathode radius and reducing the length of the emitting area 16, i.e. increasing the gap between the outer ends of the anode and the emitting area.

Preferably, a radial voltage grading structure 40 of a known type, as generally illustrated in FIG. 7, is provided at opposite ends of the magnetron in order to avoid electrical breakdown at the feed loci. This structure is of a type used to prevent arcing in particle beam accelerators, for example, and basically comprises an annular plastic cap 42 mounted on a flared transition 43 on the cathode shank and secured to the outer metallic conducting wall 44 of the vacuum chamber. An oil filled chamber 46 is located outside the cap 42. The cap has a saw tooth pattern 48 on its inner surface facing the vacuum chamber. This structure is based on well-known principles of high voltage pulsed power insulation, and designs are accessible which should withhold 800 kV for 1 microsecond.

The magnetron is preferably designed to operate in the S-band (2.60 to 3.95 GHz), but may be designed for operation at other frequencies. This design is according to magnetron operating theory, which is outlined below, and the magnetron dimensions and geometry selected will determine the operating frequency.

Figure 3:
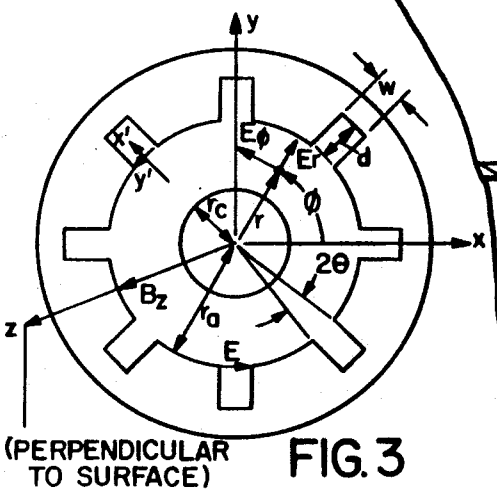
FIG. 3 is a schematic cross-section showing the electromagnetic nomenclature.

Magnetron theory will now be outlined briefly. Magnetron operation begins when an electric potential is applied between the electrodes. The magnetic field acts to insulate the electrodes by confining the electrons to the annular region inside the magnetron. The circular motion of electrons in the crossed electric and magnetic fields stimulates electromagnetic oscillations in the cavity, particularly when the velocity of the electrons matches the phase velocity of one of the normal mode components. The radiation thus formed is coupled via the waveguides from the magnetron cavity. The resonant frequencies of a magnetron can be calculated by the standard admittance matching technique, in which the RF admittance of the interaction space between the anode and cathode is set equal to the RF admittance of the resonator vanes at their common interface (see, e.g., *Microwave Magnetrons* edited by G.B. Collins, MIT Radiation Laboratory Series Vol. 6 (McGraw Hill, New York, 1948), for standard magnetron design theory). The cavity fields can be derived by ignoring the presence of electron space charge. Assuming a standard (r, $\phi$, z) cylindrical coordinate geometry of infinite length, where r is the radial co-ordinate in a standard cylindrical co-ordinate system, $\phi$ is the azimuthal co-ordinate, and z is the axial co-ordinate (perpendicular to the page in FIG. 3), the fields will have nonzero components $E_r$, $E_\phi$, and $B_z$ as illustrated in FIG. 3 where $E_r$ is the radial electric field, $E_\phi$ is the azimuthal electric field, and $B_z$ is the axial magnetic field. Boundary conditions require $E_\phi=0$ on the cathode, and zero everywhere on the anode block except where there are gaps, when the field is allowed to have a uniform amplitude E. The field varies in phase from gap space to gap space, with a phase difference between adjacent gaps of $2\pi n/N$ radians, n and N being integers. N is the total number of vane gaps, and in the nomenclature of magnetron mode identification, n is the mode number. As shown in FIG. 3, is the depth of a cavity while w is the width. In addition $r_a$ and $r_c$ are the radii of the anode and cathode respectively h is the magnetron height and $2\theta$ is the angle subtended by the gap space between adjacent magnetron vanes.

A standard technique in boundary value problems is to use a basis set of orthogonal functions which satisfy the wave equation. In this case, a combination of Bessel and Neumann functions forms a useful basis set $z_\gamma$, defined as:

$$Z_Y(kr) = J_Y(kr) - \frac{J_Y'(kr_c)}{Y_Y'(kr_c)} Y_Y(kr). \tag{1}$$

The wavenumber $k=\omega/c$ where $\omega$ is the electromagnetic mode frequency and c is the speed of light. $J_\gamma$ is a Bessel function of the first kind, order $\gamma$, $Y_\gamma$ is a Bessel function of the second kind (Newmann function), order $\gamma$, and $Z_\gamma$ represents the basis set functions for the magnetron, based on $J_\gamma$ and $Y_\gamma$. $J'_\gamma$ is the derivative of $J_\gamma$ with respect to its argument and $Y'_\gamma$ is the derivative of $Y_\gamma$ with respect to its argument. For each mode number n, the angular harmonics can be combined to satisfy the imposed boundary conditions (see Collins, supra, p. 65):

$$E_\phi(r,\phi) = \frac{EN\Theta}{\pi} \sum_{m=-\infty}^{\infty} \frac{\sin(Y\Theta)}{Y\Theta} \frac{Z_Y'(kr)}{Z_Y'(kr_a)} \exp(i\omega t + iY\phi), \tag{2}$$

$$E_r(r,\phi) = -i\frac{EN\Theta}{\pi kr} \sum_{m=-\infty}^{\infty} Y \frac{\sin(Y\Theta)}{Y\Theta} \frac{Z_Y(kr)}{Z_Y'(kr_a)} \exp(i\omega t + iY\phi),$$

$$B_z(r,\phi) = -i\sqrt{\epsilon\mu}\frac{EN\Theta}{\pi} \sum_{m=-\infty}^{\infty} \frac{\sin(Y\Theta)}{Y\Theta} \frac{Z_Y(kr)}{Z_Y'(kr_a)} \exp(i\omega t + iY\phi).$$

In the summation, the index $Y=n+mN$. $\Theta$ is the half angle subtended by the gap space between segments of the anode block. E is the electric field in the anode gap, $\Theta$ is the half angle subtended by the space between adjacent anode gaps, t is the time coordinate, and i is the square root of $-1$, and $Z'_\gamma$ is the derivative of $Z_\gamma$ with respect to its argument.

The solution is not complete because the fields in the side cavities must be matched to the interaction region fields at the gap space. The fields in the vanes are:

$$E_{y'} = e\frac{\sin[k(d-x')]}{\sin(kd)} \tag{3}$$

-continued $$H_z = -iE\sqrt{\frac{\epsilon}{\mu}} \frac{\cos[k(d-x')]}{\sin(kd)}.$$

The vane coordinates are such that z is along the magnetron axis, and x' measures depth into the vane. The orthogonal axis y' is aligned with the direction of $\phi$. $\epsilon$ is the permittivity of free space and $\mu$ is the magnetic permeability of free space, while $H_z$ is the axial magnetic intensity.

As one might expect, the fields will match only at particular frequencies which are resonances of the system. The frequencies are found by setting the RF admittance of the interaction space equal to the RF admittance of the vanes at their common interface. The RF admittance is expressed as a spatial average of the Poynting flux, giving the following dispersion relation:

$$i\sqrt{\frac{\epsilon}{\mu}} \frac{Nh}{2\pi r_a} \sum_{m=-\infty}^{\infty} \left[\frac{\sin(Y\Theta)}{Y\Theta}\right]^2 \frac{Z_Y(kr_a)}{Z_Y'(kr_a)} = -i\frac{h}{w}\sqrt{\frac{\epsilon}{\mu}} \cot(kd). \tag{4}$$

The magnetron's height is denoted by h. This transcendental equation for the frequency is usually solved graphically by plotting both the admittances of the interaction space and the vanes (the left and right hand sides of the dispersion equation) as a function of frequency; points where the lines intersect give $\omega$. There are an infinite number of resonances or solutions for each mode number n, but only the lowest ones will be important. In the design described above, the calculated lowest order $\pi$-mode frequency was 3.17 GHz. The lowest eight mode frequencies for this magnetron, including the lowest order frequency for the $\pi$-mode where $n=4_0$, are tabulated below. In Table 1, the subscripts on each of the mode numbers 0, 1, 2, 3 and 4 refer to the order of the mode. Each mode branch, defined by the principal number, has an infinite number of solutions, similar to harmonic frequencies, in the magnetron dispersion relation. The subscript orders these solutions, with subscript 0 referring to the lowest order. Thus, the lowest order frequency for mode 1 is represented by $1_0$, the order 1 frequency is represented by $1_1$, and so on. Although there is a relatively small (3.5%) mode separation between the $\pi$-mode and adjacent modes, which could potentially result in unstable and reduced performance as a result of mode competition, this effect is reduced by the maintenance of angular symmetry and the fact that power is extracted symmetrically from half of the resonator vanes.

TABLE 1

Lowest Normal Modes Calculated from the Dispersion Relation for the Magnetron.

| MODE # | FREQUENCY (GHz) |
|---|---|
| $1_0$ | 1.97 |
| $2_0$ | 2.68 |
| $3_0$ | 3.06 |
| $4_0$ ($\pi$-mode) | 3.17 |
| $0_1$ | 3.77 |
| $1_1$ | 3.93 |
| $2_1$ | 4.42 |

The power and magnetic field needed to operate the magnetron may also be calculated according to standard theory. The static fields consist of the applied electric field due to the potential difference between anode and cathode, the applied axial magnetic field, and the fields due to space charge. Brillouin derived a self-consistent solution for the space charge in the absence of RF fields (see L. Brillouin, *Phys Rev.* 60, 385 (1941)). This described electrons in circular orbits about the cathode. A relativistic version of this solution is derived below. This solution is useful in modeling the initial condition of the magnetron prior to RF oscillation.

The scalar potential, $A_0$, is solved under conditions of space charge limitation at the cathode: this means that all potentials and radial components of fields are zero at the cathode. By assumption, there will be no radial component to velocity, namely no net current. The voltage at the anode is the critical potential known as the Hull cutoff, when the space charge cloud extends exactly out to the anode. (The latter condition is a simplification, not a necessary assumption.)

The dynamics of electron motion are described by a relativistic Langrangian:

$$L = -mc^2\left(1 - \frac{r^2 + r^2\phi^2}{c^2}\right)^2 + eA_0 - \frac{e}{c}(rA_r + r\phi A_\phi). \tag{5}$$

where L is the relativistic Lagrangian function, e is the charge on an electron and m is the electron mass, $A_0$ is the scaler potential, $A_r$ is the radial component of the vector potential and $A_\phi$ is the azimuthal component of the vector potential. This equation already accounts for the algebraically negative charge on the electron, where the absolute value of the charge, $|e|$, is equal to $=4.80\times10^{-10}$ statcoulomb in Gaussian-CGS units.

The self-consistent Brillouin solution follows fairly easily. The Lagrange equation for $\phi$ is integrated immediately to solve for the angular velocity of electrons. The scalar potential can be derived from the Hamiltonian function, which is constant since L does not explicitly depend upon time. Finally, the density of the self-consistent electron charge cloud is computed from the scalar potential using Poisson's equation.

The results of the calculation for the static field, space charge, and electron orbits are summarized below. First, it is convenient to define a dimensionless cyclotron frequency:

$$\Omega = \frac{1}{2}\,\frac{eB_0}{mc}\,\frac{r_c}{c}. \tag{6}$$

The static potentials are given by:

$$A_\phi = \frac{mc^2}{e}\,\Omega\,\frac{r}{r_c}\left(1 - \frac{r_c^2}{r^2}\right) \tag{7}$$

$$A_0 = \frac{mc^2}{e}\left\{\left[1 + \Omega^2\frac{r^2}{r_c^2}\left(1 - \frac{r_c^2}{r^2}\right)^2\right]^{\frac{1}{2}} - 1\right\}.$$

Note that the imposed magnetic field is $B_0$, and the imposed voltage, by assumption, is the critical Hull voltage. For voltages less than the Hull voltage, the space charge extends only part way into the interaction region: in this case, a logarithmic solution of the potential exists in the empty region out to the anode, and must be matched with the scalar space-charge potential at the radius of the space-charge surface.

The relativistic Brillouin space charge cloud is described as follows for the Hull voltage:

$$r=0$$

$$\phi = \frac{c}{r_c}\,\Omega\left(1 - \frac{r_c^2}{r^2}\right)\left[1 + \Omega^2\frac{r^2}{r_c^2}\left(1 - \frac{r_c^2}{r^2}\right)^2\right]^{-\frac{1}{2}} \tag{8}$$

$$n = \frac{mc^2}{4\pi e^2 r_c^2}\,\Omega^2\,\frac{2\left(1 + \frac{r_c^4}{r^4}\right) + \Omega^2\frac{r^2}{r_c^2}\left(1 - \frac{r_c^2}{r^2}\right)^4}{\left[1 + \Omega^2\frac{r^2}{r_c^2}\left(1 - \frac{r_c^2}{r^2}\right)^2\right]^{\frac{3}{2}}}$$

where r is the time derivative of the radial coordinate and $\phi$ is the time derivative of the azimuthal coordinate. In the nonrelativistic limit, $\Omega$ is small compared with unity, and the above formulas for $A_0$, time rate of change in $\phi$, and n reduce to Brillouin's results (see L. Brillouin, supra, Eqs. 23, 25 and 25).

The magnetic field and voltage characteristics will now be considered. The minimum voltage for which oscillations can develop is determined from the condition that the ExB drift velocity (the time rate of change of $\phi$ given in Eq. 8) provides a resonance with the angular velocity of the electromagnetic mode ($\omega_0=\omega/n$) at $r=r_a$. This is the Buneman-Hartree voltages. The relativistic generalization of the Buneman-Hartree voltage is:

$$\frac{eV_{BH}}{mc^2} = \frac{\omega r_c}{nc}\,\Omega\,\frac{r_a^2 - r_c^2}{r_c^2} + \left[1 - \left(\frac{\omega r_a}{nc}\right)^2\right]^{\frac{1}{2}} - 1. \tag{9}$$

(See A. Palevsky and G. Bekefi, *Phys. Fluids* 22, 986 (1979)). The voltage must also be less than the Hull voltage, $V_H$ the critical voltage for which the space charge extends out to the anode (the value of $A_0$ given above at the anode; also see W.P. Ballard, "A Relativistic Magnetron with a Thermionic Cathode", Ph.D. dissertation, Stanford University IPR Report No. 840, 1981, p. 32):

$$\frac{eV_\mu}{mc^2} = \left[1 + \left(\Omega\frac{r_c}{r_a}\,\frac{r_a^2 - r_c^2}{r_c^2}\right)^2\right]^{\frac{1}{2}} - 1. \tag{10}$$

The above equations for the Buneman-Hartree and Hull voltages as a function of magnetic field define a region in voltage and magnetic field space where the magnetron will operate.

Figure 5:
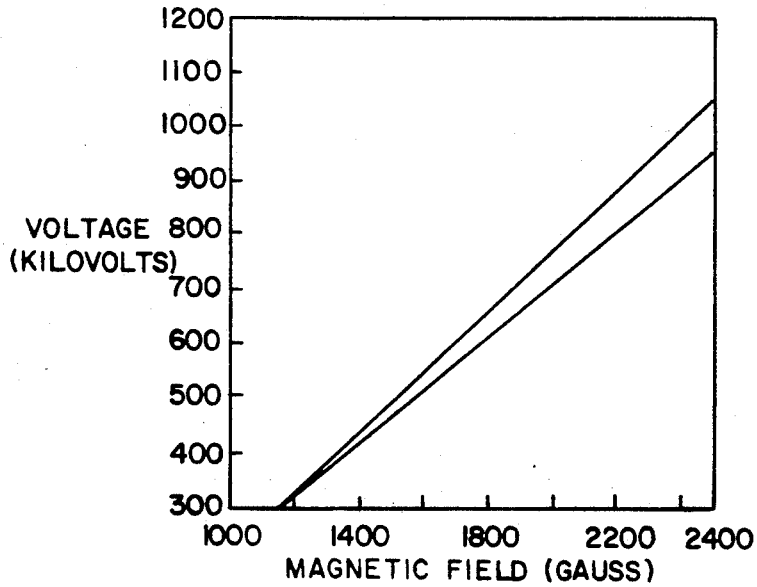
FIG. 5 is the Buneman-Hartree diagram for the magnetron of FIGS. 1 and 2, illustrating the range within which the magnetron will oscillate.

This region is illustrated graphically in FIG. 5 for the magnetron illustrated in FIGS. 1 and 2. The magnetron will operate in the region between the two lines which represent the Hull cutoff and the Buneman-Hartree limit.

In a given mode of oscillation, the electric field contains many angular components. Since each component has a different phase velocity, an electron cloud rotating with a uniform angular velocity can resonate with only one of them. A useful approximation is to assume that the electrons interact only with the slowest rotating angular component of the mode traveling in the same sense as the electrons.

For operation in the $\pi$-mode, $n=N/2$. Since the electron rotates counterclockwise (looking down on the magnetic field), the choice of interacting component would be $Y=-N/2$, or $m=-1$. A coordinate system rotating with angular velocity $\omega_0=2\omega/N$, will be rotating at the same rate as the $m=-1$ component of the $\pi$-mode, and the perturbing field will be constant in time. The self-consistent electromagnetic field can then be formulated in terms of a potential field, a useful simplification for the computer simulation.

In subsequent equations, primed quantities will refer to quantities in the rotating frame. Angular components in the rotating frame are related to the stationary coordinates as $\phi=\phi'+\omega_0 t$.

An analysis of the physics of the magnetron interaction requires a knowledge of the electron dynamics.

Formally, the relativistic equations of motion are derived using Lagrangian mechanics (see, for instance, G.B. Collins, *Microwave Magnetrons*, supra, p. 224, Eqs. 23R and 24R). In the following set of equations, the magnetic field component of the electromagnetic wave is ignored, and the electric field component is computed from the static potential field derived in the rotating frame:

$$\frac{d}{dt}\left[\frac{mr}{(1-\beta^2)^{\frac{1}{2}}}\right]=\frac{mr\dot{\phi}^2}{(1-\beta^2)^{\frac{1}{2}}}+\frac{e^{\partial}}{\partial r}(A_0)-\frac{2mcr\Omega}{r_c}\dot{\phi} \tag{11}$$

$$\frac{d}{dt}\left[\frac{mr^2\dot{\phi}}{(1-\beta^2)^{\frac{1}{2}}}\right]=\frac{e^{\partial}}{\partial\phi'}(A_0)+\frac{2mcr\Omega}{r_c}\dot{r}.$$

where $\beta$ is the dimension-less velocity coefficient equal to v/c. The nature of the forces will be described only briefly.

The contributions to the rate of change in velocity involving the cyclotron frequency $\Omega$ are due to Lorentz forces from the static magnetic field. These forces can be shown to result in counterclockwise rotation of electrons being accelerated radially outward from the cathode.

Electrical forces in the magnetron are due to the combined fields associated with the imposed voltage on the anode, the self-consistent space-charge cloud, and the electromagnetic wave. In a coordinate system rotating in synchronism with the $m=-1$ component of the electromagnetic mode, the now-static field can be expressed in terms of a potential field. In practice, Poisson's equation for the potential, $A_0$, derived when Poisson's equation is inverted for a given space charge density in the cavity, subject to these boundary conditions:

$$\begin{aligned} A_0 &= -\frac{E_0 r_a}{N/2}\sin\left(\frac{N\phi}{2}\right)Z_{N/2}'(kr_a)+V_0 \text{ at anode} \\ &= 0 \text{ at cathode,} \end{aligned} \tag{12}$$

where $Z'_{N/2}$ is the value of the derivative of the basis set functions of order N/2 (see equation 1) with respect to kr calculated at a value of r equal to $r_a$, and $V_0$ is the potential between the anode and the cathode. The resulting electrical forces derive from spatial derivatives of this potential. Relativity in the rotation of the reference frame is not included here. $E_0$ in this equation is the electric field amplitude, and is related to E, the field in the anode gaps:

$$E_0=\frac{EN\Theta}{\pi}\;\frac{\sin(N\Theta/2)}{N\Theta/2}\;\frac{1}{Z_{N/2}'(kr_a)}. \tag{13}$$

Those contributions to the radial equation which are independent of electromagnetic forces can be attributed to centripetal accelerations.

Finally, because the Lagrangian has no explicit time dependence, the Hamiltonian is a conserved quantity. Therefore, for each electron, the following quantity is constant in time:

$$\frac{H}{mc^2}=\frac{1}{mc^2}\left\{\frac{m}{(1-\beta^2)^{\frac{1}{2}}}[c^2-\omega_0 r^2(\dot{\phi}'+\phi_0)]-\frac{e}{c}(cA_0-r\,\omega_0 A_\phi')\right\}. \tag{14}$$

where $\omega_0$ is the angular velocity of the electromagnetic mode, $A_\phi$, is the azimuthal component of the vector potential in a rotating frame, and $\phi$ is the azimuthal cylindrical coordinate in a rotating frame.

The current out of the cathode can only be so large before the accumulation of space charge screens out the accelerating radial field. The limiting current without a magnetic field is known as the Langmuir-Child current. It can be derived from a self-consistent, nonlinear solution of Poisson's equation, the charge continuity equation, and an energy equation. In a cylindrical geometry, a nonrelativistic formula, based on a treatment by Langmuir, for the limiting current density at the cathode is given as follows (see I. Langmuir, *Phys. Rev.* 2, 458 (1913)):

$$j_c=\frac{2.34\,V^{3/2}}{\beta^2 r_a r_c}\;kA/\text{cm}^2, \tag{15}$$

where $r_a$ and $r_c$ are in cm, and V is the voltage in megavolts (MV). The factor $\beta^2$ is a function of $r_a/r_c$, and is tabulated in L. Brillouin, supra. For the preferred version of the magnetron of this invention, $r_a/r_c=2.6$, and $\beta^2=0.42$.

The dimensions of the anode, cathode, and resonators were selected in order to produce the desired operating characteristics of the magnetron, and to increase efficiency of operation. The ratio of the anode and cathode radii was controlled to be close to the value of e (2.718), and in the preferred embodiment was 2.6. This reduces electric field stresses and mitigates unwanted breakdown within the magnetron. The actual values of the radii were selected according to several considerations. One of these was to keep the anode-cathode gap spacing as large as possible both so that the magnetron will operate in the desired $\pi$-mode, which is the mode of greatest stability, and also in order to increase output pulse duration while still maintaining adequate field emission. Generally speaking, in previous relativistic magnetron designs, small millimeter size anode to cathode gaps were required in order to induce field emission. However, this resulted in short pulse lengths due to formation and diffusion of plasma in the anode-cathode gap, which either electrically shorts out the magnetron or causes early quenching of the RF pulse. In the present design, an anode-cathode gap spacing of about 3 cm can be used, because of the use of the special fibrous or felt material for the cathode surface which permits ignition at much lower electrical field stresses. Standard magnetron cathode materials need a typical 250 kV/cm for ignition, requiring either very small anode-cathode gaps or megavolt level voltages for ignition, both of which have other undesirable side effects. In contrast, the material used for the cathode surface of the magnetron described above allows a large spacing of about 3 cm while permitting relatively low voltages in the range 500 to 800 kV to fire the magnetron. The modulators supplying power to the magnetron can therefore be of reduced size and have less stringent design requirements, permitting the use of militarily compact, transportable and rugged modulators. Although there will be less overall current into the magnetron, lowering the peak emitted power, this is not necessarily a disadvantage since, at the same time, conversion efficiency will be increased and a significantly longer pulse length can be produced.

Another design consideration was the radius of the cathode. This should be as large as possible in the case of a uni-directional feed current to minimize the azimuthal self-magnetic field created by the uni-directional feed. At the same time, the cathode emission area and total electrical power into the magnetron should be maximized.

In one specific example the values of the anode and cathode radii were 4.61 cm and 1.75 cm respectively. The resonator cavities had a width of 1.34 cm and a depth of 1.75 cm, and the angles subtended by the resonator width and the interresonator wall were relatively close. The resonator width and anode-cathode gap were relatively close in dimensions. At these dimensions, the co-axial waveguide end spaces of the magnetron will be in cut off at the $\pi$-mode frequency.

The anode height in this example was 10 cm. In practice, the height of the anode must greater than the width of a standard S-band waveguide, to permit waveguide extraction from alternate vanes or cavities of the magnetron as illustrated in the drawings. At the same time, the anode height must be short enough to avoid higher order axial mode competition at the $\pi$-mode. The length of the cathode emitting area 16 is another important consideration. It is spaced inwardly from the outer ends of the anode in order to reduce loss of electrons axially out of the interaction area and avoid arcing to endcap plates. However, it should be made as long as possible in order to maximize the emitting surface area. With a unidirectional current feed, the emitting area length is preferably restricted to 4 cm straddling the magnetron equator, leaving a 3 cm gap at each end within the anode to reduce electron losses resulting from the azimuthal magnetic field. With symmetrical current feed to both ends of the cathode, this length can be increased up to around 8 cm, thereby increasing input and output power.

The power and magnetic field needed to operate the magnetron were calculated according to the standard theory described above. Magnetrons oscillate only within a range prescribed by the Hull and Buneman-Hartree conditions. The Hull voltage is the critical potential at which the space charge cloud will extend exactly out to the anode, while the Buneman-Hartree voltage is the minimum voltage for which oscillations can develop. Both of these voltages are dependent on the applied magnetic field, and when plotted as a function of magnetic field define a region in voltage and magnetic field space where the magnetron will operate. FIG. 5 illustrates the Buneman-Hartree condition for the magnetron illustrated in FIGS. 1 and 2 having the dimensions described above.

In one example of a magnetron designed as illustrated and described above, a single magnetron body was cut as one piece from 6 inch diameter brass tubular rod. Eight resonator vanes were cut into the inner face of the tube, with alternate vanes being cut through to the outer face (see FIG. 2) at which the impedance transformers and output waveguides were attached. The magnetron was hot-tested by applying a negative potential from 600 kV to 1 MV at the inner cathode while keeping the anode or external magnetron body at ground. The emitting area or band 16 had a length of 4 cm and straddled the equator of the magnetron.

Figure 6:
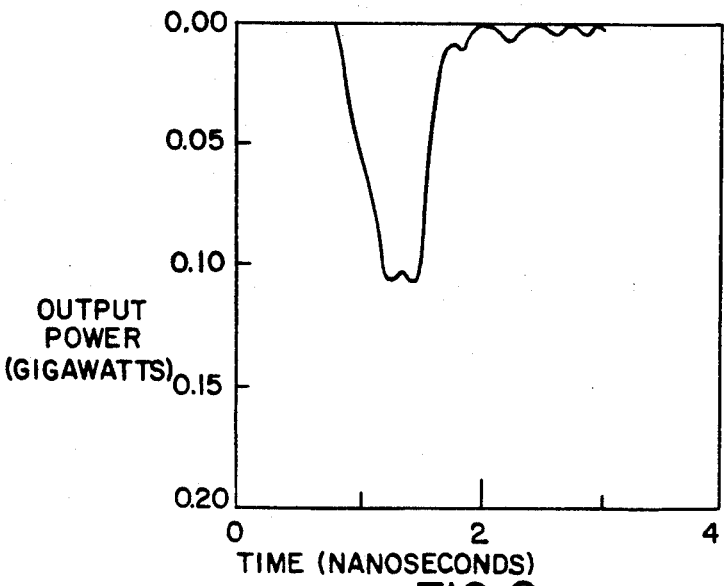
FIG. 6 illustrates a typical output pulse obtained in hot testing the magnetron.

With a single body magnetron as described above with a unidirectional current feed, typical RF power outputs of 125 MW were achieved with an input potential of 680 kV, while an output of 207 MW was produced at 1070 kV. Power above 200 MW was produced at inputs of 1 MV, but sporadic internal breakdown occurred. FIG. 6 illustrates a typical output pulse achieved with this magnetron. As illustrated in FIG. 6, this produced an RF pulse which was sometimes flat topped and had a typical pulse duration of 80 ns, which is considerably longer than with standard relativistic magnetrons. In this example, the RF pulse duration was limited only by the termination of the driver pulse. Thus, this design has the potential capability of producing longer microwave pulses continuing on the order of several hundred joules.

The relatively modest magnetic field strength permits the use of permanent magnets, if desired, reducing energy requirements over the electromagnets normally required for operating relativistic magnetrons.

The magnetron described above combines the advantages of hot (thermionic) and cold (field emission) cathode approaches to magnetron design, while circumventing some of their inherent disadvantages. It is particularly useful as an RF source in military applications of high power microwaves. It has relatively modest operating voltage (in the range from 500 to 800 kV, resulting from the use of a particular cathode material, which will ignite at relatively low electric field stresses), high impedance (around 100 ohms), high efficiency, and facilitates the use of permanent magnets to generate the axial magnetic field. This permits the use of militarily compact, transportable, and rugged modulation at the power input. Since permanent magnets can be used, power requirements are lower.

The carbonized felt material used for the emitting band of the cathode has the advantage that an electron beam can be formed at a lower standoff voltage, allowing lower operating voltages to be used as well as a larger anode to cathode gap, leading to increased pulse length. The cathode material also allows electron emission to be limited to specific regions, improving magnetron efficiency and reducing axial currents, and reducing anode erosion. This type of cathode material also has a demonstrated longer shot lifetime of the order of several hundreds of shots as compared to other so-called "fuzzy" cathode materials.

Computer simulations utilizing the theory outlined above indicate that magnetron efficiency drops as the applied voltage increases. This is a consequence of the relativistic enhancement in electron mass, making it increasingly difficult for the electrons to maintain resonance with the generated electromagnetic waves. Thus, the low operating voltages possible with this magnetron will improve efficiency. Although the peak emitted power of the magnetron will be lower as a result of the lower input voltage, the conversion efficiency and output pulse length will be increased.

The magnetron described above has increased efficiency, longer output pulse length, and is believed to have longer operational lifetime than previous magnetron designs. The magnetron operates cleanly and stably in the desirable $\pi$-mode, and has an estimated power conversion efficiency of 35%.

Although a preferred embodiment of the invention has been described above by way of example only, it will be understood by those skilled in the field that modifications may be made to the disclosed embodiment without departing from the scope of the invention, which is defined by the appended claims.

We claim:

1. A relativistic magnetron device, comprising:

an elongate cathode shank having a longitudinal axis defining a central longitudinal axis of the device, the shank having opposite outer axial ends, a central electron emitting band of field emitting relativistic magnetron cathode material extending along a central portion of the cathode shank, the band having opposite ends terminating short of the outer axial ends of the shank, and non-electron emitting bands extending from respective ends of the emitting band to the respective outer axial ends of the cathode shank;

a tubular cylindrical anode surrounding said emitting band of said cathode shank and having outer ends projecting beyond the respective ends of said emitting band, the anode having an inner surface facing said cathode shank to define an annular interaction area between the anode and cathode, said annular interaction area being of substantially uniform cross-sectional area between said outer ends of said anode, and the inner surface of the anode having an even number of identical resonator cavities extending into said anode;

extraction means coupled to alternate ones of said resonator cavities for extracting microwave energy from alternate ones of said resonator cavities;

electric field generating means connected between said anode and said cathode shank for generating a radial electric field between said anode and said cathode shank to induce electron emission from said field emitting cathode material in said emitting band; and magnetic field generating means disposed outside said anode for generating an axial magnetic field in said annular interaction area;

whereby said electric and magnetic field generating mean comprise means for forming crossed electric and magnetic fields in said annular interaction area through which said electrons move to induce electromagnetic fields in said cavities.

2. The device as claimed in claim 1, wherein said extraction means comprises a plurality of separate output waveguides, each waveguide being connected to a respective one of said alternate resonator cavities.

3. The device as claimed in claim 1, including tubular waveguide members projecting co-axially from said opposite ends of the anode, the cathode shank projecting outwardly in opposite axial directions from said interaction area into said waveguide members to define annular end spaces at said opposite ends of said anode, said end spaces comprising means for establishing a standing wave pattern at a predetermined operating frequency.

4. The device as claimed in claim 1, in which the emitting band is centrally surrounded by said anode and the ends of the cathode emitting band each terminate short of the respective ends of the anode by a predetermined distance.

5. The device as claimed in claim 1, including annular end caps at said opposite ends of the anode for capping the resonator cavities.

6. The device as claimed in claim 5, wherein the inner surface of said cylindrical anode between said resonator cavities has an internal diameter equal to an inner diameter of the annular end caps.

7. The device as claimed in claim 5, including a pair of tubular waveguide projections, each waveguide projection being coupled at one end to a respective one of said end caps and extending outwardly from said end cap and coaxial with said cathode to define annular waveguide end spaces of predetermined dimensions projecting from and communicating with said interaction area.

8. The device as claimed in claim 7, including voltage grading means connected between each waveguide projection and the respective adjacent outer end of the cathode for resisting electrical breakdown.

9. The device as claimed in claim 1, including symmetrical current input means operatively coupled to said opposite ends of said cathode for feeding current symmetrically to both ends of said cathode.

10. The device as claimed in claim 1, wherein the electron emitting band of the cathode comprises a cathodic, emitting material having a non-smooth surface texture.

11. The device as claimed in claim 10, wherein the cathode comprises a cylindrical shank of anodized, non-emitting material having a surface coating layer of said emitting material extending along said central portion of said shank, said coating layer comprising said emitting band.

12. The device as claimed in claim 11, wherein said coating layer is of graphite felt cathode material.

13. The device as claimed in claim 1, wherein the annular interaction area between the anode and cathode shank has a depth of at least 1 cm.

14. A relativistic magnetron device, comprising:

an elongate cylindrical cathode shank of predetermined length having a longitudinal axis defining a central axis of the device;

a tubular cylindrical anode having opposite ends, said anode surrounding said cathode shank along at least part of the length of the cathode shank to define an annular interaction cavity between the anode and cathode;

electric field generating means connected between said anode and said cathode shank for applying an electric field between the anode and the cathode shank;

magnetic field generating means disposed outside said anode operatively coupled to said cavity for generating a magnetic field in said cavity; and a central area of said cathode shank surrounded by said anode comprising a band of field emitting relativistic magnetron cathodic material, the field emitting band comprising a layer of cathode material having a non-smooth surface texture bonded to said cathode shank in said central area, said field emitting band having opposite ends terminating short of respective opposite ends of the anode, and the remainder of said cathode shank being of non-emitting material.

15. The device as claimed in claim 14, wherein said material comprises a graphite felt cathode material.

* * * * *